US006009300A

United States Patent [19]

Kagawa et al.

[11] Patent Number: 6,009,300

[45] Date of Patent: Dec. 28, 1999

[54] TONER IMAGE FIXING MEMBER, FIXING ROLLER AND FIXING DEVICE

[75] Inventors: Toshiaki Kagawa, Sakurai; Taisuke Kamimura, Kitakatsuragi-gun; Syougo Yokota, Fujiidera; Hisasi Atarasi, Nabari, all of Japan

[73] Assignee: Sharp Kabushiki Kaisha, Osaka, Japan

[21] Appl. No.: 09/006,361

[22] Filed: Jan. 13, 1998

[30] Foreign Application Priority Data

Jan. 31, 1997 [JP] Japan ..... 9-018022

[51] Int. Cl.[6] ..... G03G 15/20

[52] U.S. Cl. ..... 399/333; 219/469

[58] Field of Search ..... 399/330, 333; 219/216, 469

[56] References Cited

U.S. PATENT DOCUMENTS 5,717,988 2/1998 Jinzai et al. ..... 399/333

5,722,026 2/1998 Goto et al. ..... 399/333

FOREIGN PATENT DOCUMENTS 7-46254 5/1995 Japan .

7-219375 8/1995 Japan .

*Primary Examiner*—William J. Royer

*Attorney, Agent, or Firm*—David G. Conlin; George W. Neuner

[57] ABSTRACT

In a toner image fixing roller covered with a fluororesin layer, to evenly apply anti-offset agent to the roller surface and to increase sharpness of edge-portions of a toner image fixed on recording paper, a fixing roller consists of a core, elastic body layer and a fluororesin layer. The fluororesin layer contains filler (silicone oil or silicone powder) having affinity to anti-offset agent.

16 Claims, 3 Drawing Sheets

TONER IMAGE FIXING MEMBER, FIXING ROLLER AND FIXING DEVICE

BACKGROUND OF THE INVENTION

The present invention relates to a toner image fixing member, fixing roller and fixing device for use in an electrophotographic apparatus using an electrophotographic process, such as a copier, facsimile and printer, and more particularly to an electrophotographic apparatus capable of printing a full color image.

A conventional fixing device used in an electrophotographic apparatus (e.g., a copier or a printer) is usually of the heating roller type wherein an unfixed recording paper with an unfixed toner image passes through a nip between paired fixing rollers being heated to fuse and fix the toner image thereon. In particular, a full color printing electrophotographic machine necessarily uses a fixing device which has fixing rollers covered with silicone rubber, on the surface of which is applied an anti-offset agent such as silicone oil having a small surface energy on the surfaces of the rotating rollers to prevent toner from adhering to the roller surfaces (i.e., preventing so called offsetting toner to another print).

However, the silicone rubber cover of a fixing roller is not so durable and may suffer deterioration of its surface quality by friction with recording paper and toner particles, causing offsetting toner to the roller only at and after 20000 printing cycles.

Japanese Laid-open Patent Publication No. 7-219375 proposes a method for covering the roller surface with a layer made of fluororesin having an excellent durability. The roller covered with a fluororesin layer, however, can not be evenly wetted with a silicone oil because the fluororesin layer has a small surface energy and, therefore, a small wettability with silicone oil.

To solve the above-mentioned problem, two methods were recently proposed, one of which is to use silicone oil denatured to have an improved wetting ability to fluororesin and the other is to improve the wettability of a fluororesin layer of the roller with silicone oil by modifying the fluororesin layer surface itself to have a reduced surface tension.

The former method, however, was accompanied by some new problems that silicone oil denatured in respect to fluororesin is rather expensive than standard silicone oil and may produce toxic fluorine gases when it is heated at a high temperature. The latter method was accompanied by an increased surface roughness of the fluororesin surface to be easily contaminated with toner.

Furthermore, a fluororesin-covered fixing roller in comparison with a silicone-rubber-covered fixing roller has a higher hardness (less elasticity) and, therefore, is inferior in ability of following up a toner image and an uneven surface of recording paper. Consequently, the roller may not sufficiently heat a toner image in particular at edge portions thereof, resulting in poor sharpness of corresponding portions of the image.

SUMMARY OF THE INVENTION

To solve the above-mentioned problems, the present invention has as its object the provision of a toner image fixing member having a fluororesin surface layer containing a filler having affinity to anti-offset agent.

The fixing member has an improved wettability to permit anti-offset liquid to be evenly applied to the entire surface of the fixing member. In addition, the fixing member has a relatively low hardness of its surface that may surely fix a toner image on paper, obtaining an improved sharpness of edge portions of the image.

Another object of the present invention is to provide a toner image fixing roller having a fluororesin surface layer containing a filler having affinity to anti-offset agent.

The fixing roller has an improved wettability with anti-offset agent and, therefore, its surface can be evenly coated with anti-offset agent. In addition, the fixing roller has a reduced hardness of its surface that may surely fix a toner image on paper, obtaining an improved sharpness of edge portions of the image.

The present invention proposes the use of silicone oil or silicone powder as filler material which content in the surface layer is suitable within 0.1 to 3%.

The silicone powder shall have an average particle size of not larger than 13 microns in diameter to prevent a possible decrease of mechanical strength of the fluororesin surface layer due to addition of the silicone powder.

Another object of the present invention provides a toner image fixing roller having a surface layer containing a large portion of the filler in its outside and a small portion in its inside.

The large distribution of filler components in the top surface of the fluororesin layer can realize, at a minimum amount of the filler, considerable improvement of the fixing roller peformance as to wettability of the layer with anti-offset agent and sharpness of edge portions of a toner image fixed on recording paper.

Another object of the present invention is to provide a toner image fixing roller having a surface resin layer made of a copolymer of two components: a first monomer having affinity to anti-offset agent and a second fluororesin monomer.

The surface layer made of the copolymer of two kinds of resin monomers in comparison with a conventional surface layer made of fluororesin with silicone filler may have the following such advantageous features as:

(1) The resin layer has an increased mechanical strength.

(2) There is no fear of swelling of silicone filler with anti-offset agent.

Namely, the copolymer resin layer may possess excellent properties that the only blended resin layer could not achieve.

Another object of the present invention is to provide a toner image fixing device provided with a pair of fixing rollers which are rotated in contact with each other under a certain pressure and anti-offset applying means for applying anti-offset agent to an external cylindrical surface of at least one of the fixing rollers, and for fixing an unfixed toner image formed on a recording medium by feeding said medium between said rollers characterized in that at least one of the fixing rollers is any one of the above-mentioned fixing rollers.

The above-mentioned construction of the toner-image fixing device assures evenly applying the anti-offset agent to the fixing roller surface (otherwise, uneven coating of the agent may cause partial lacking of a toner image fixed on recording paper) and achieves a sharp edging of the toner image by means of the fixing roller having a reduced surface strength.

PREFERRED EMBODIMENTS OF THE INVENTION

Referring now to the accompanying drawings, preferred embodiments of the present invention will be described in detail as follows:

[Embodiment 1]

Figure 1:
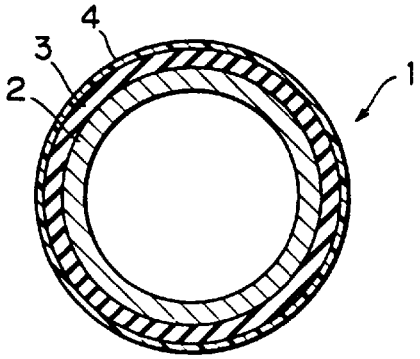
FIG. 1 is a schematic sectional view of a toner-image fixing roller which is the first embodiment of the present invention.

FIG. 1 is an illustrative of a fixing roller which is a first embodiment of the present invention.

In FIG. 1, a fixing roller 1 is constructed of a core 2, an elastic layer 3 formed on a cylindrical surface of the core 2 and a fluororesin layer 4 covering the elastic layer 3. The core 2 is made of metal, e.g., steel, aluminum and so on. The elastic layer 3 formed on the core 2 is made usually of silicone rubber or fluororesin rubber, which possesses an excellent heat resistance. This embodiment has the core 2 made of aluminum and the elastic layer 3 made of silicone rubber.

The fluororesin layer 4 may be formed on the elastic layer 3 by either of two methods: one method is to apply dispersion liquid of fluororesin to the elastic layer and then bake; and the other method is to previously form a tube of fluororesin and integrally form the tube with the elastic layer 3 on the core 2 or bond it onto the elastic layer 3 formed on the core 2.

The latter method is preferable to use since it assures higher durability of the fluororesin layer and has no fear of deterioration of baked resin. This embodiment uses a fluororesin tube for covering the fixing roller.

The fluororesin tube 4 is described in detail as follows:

Fluororesin for making the fluororesin tube 4 may be polytetrafluoroethylene(PTFE), tetrafluoroethylene-pafluoroalkylvinylethylether copolymer (FFA) and so on. The fluororesin is formed into a tube by extrusion molding. The tube is desired to have a wall thickness of 30 to 100 mm to assure the elasticity of the fixing roller surface and mechanical strength of the tube itself. In the shown instance, the tube 4 is formed to be of 50 mm in wall thickness. Filler having affinity to anti-offset agent is added to the fluororesin before extrusion molding of the tube 4. Silicone oil is usually used as the anti-offset agent, so silicone oil or silicone powder is preferably applied as the filler.

The filler (silicone oil or powder) may be added directly to the fluororesin in a hopper by a usually used automatic screw feeder or it may be previously blended with the fluororesin to form master pellets of high concentration and a necessary amount of these master pellets are added to the fluororesin to be molded.

Any silicone oil such as dimethylsilicone oil, methylhenyl silicone oil, polyether denatured silicone oil and alkyl denatured silicone oil may be used as filler in accordance with a kind of silicone oil used as anti-offset agent. Commercially available rubber powder, resin powder and silica powder may be used as silicone powder filler.

The addition of silicone-oil filler or silicone-powder filler can improve the wettability of the fluororesin tube 4 with respect to silicone oil to be applied thereto for preventing toner from adhering to the roller. Furthermore, a reduced surface hardness of the filler-added fluororesin tube 4 may permit an elastic deformation of the fixing roller surface to follow unevenness of a recording paper surface. This realizes an improved sharpness of the edge portion of the toner image fixed on the recording paper. In particular, silicone oil filler has such an advantage that it can be easily added when molding fluororesin and can well disperse and be evenly distributed in the molded fluororesin. The advantage of silicone powder filler over silicone oil filler is easily to reduce a hardness of the fluororesin layer, thus realizing improvement of quality of fixed toner image at edge portions in particular.

It is important to adjust an addition of silicone oil filler or silicone powder filler so that a filler content in fluororesin may be within 0.1 to 3 wt. %., because the fluororesin tube 4 having the filler content of less than 0.1% is poor in wettability with respect to silicone oil to be applied as anti-offset agent, while the fluororesin tube 4 having the filler content of more than 3% has a reduced mechanical strength and a shortened life time.

It is important to use silicone powder filler having an average particle diameter of not larger than 13 mm. The fluororesin tube 4 having the silicone powder filler whose particle size exceeds 13 mm in average has a reduced mechanical strength and a shortened life time.

For a practical example, fluororesin PFA with 1% addition of dimethyl silicone oil having a viscosity of 10000 cs (KF-96, product of Sin-etsu Kagaku Kogyo) was formed by extrusion molding into a tube having a 50 mm thick wall, which was then bonded to an elastic body layer 3 with one-component liquid type silicone rubber adhesive.

[Embodiment 2]

Figure 2:
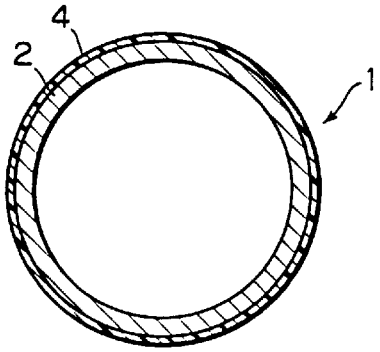
FIG. 2 is a schematic sectional view of a toner-image fixing roller which is the second embodiment of the present invention.

FIG. 2 is illustrative of a fixing roller according to a second embodiment of the present invention.

In FIG. 2, a fixing roller 1 is constructed of a core 2 and a fluororesin layer 4 formed on a cylindrical surface of the core 2. The core 2 is made of aluminum. Its surface is completely degreased and treated by sand blasting to have a surface roughness of 5 mm in average per 10 points. The roughened surface of the core 2 is then coated with dispersed fluororesin liquid and is baked to form thereon a fluororesin layer of 12 mm in thickness.

The fluororesin layer 4 formed on the roller core 2 in this embodiment will be described in detail below.

Fluororesin for the fluororesin layer 4 may be polytetrafluoroethylene (PTFE), tetrafluoroethylene-pafluoroalkylvinylethylether copolymer (FFA) and so on. A filler having affinity to anti-offset agent is added to fluororesin when baking the coating layer. As described in the first embodiment, silicone oil or powder may be used as filler. The amount of added silicone-oil filler or silicone-powder filler is the same as in the first embodiment. Namely, the filler content of the fluororesin is preferable within 0.1 to 3%.

A mixture of fluororesin and filler is usually prepared by mixing dispersed liquid or solution or powder and stirring the mixture. In this embodiment, a mixture of dispersed PFA liquid with 1% addition of silicone powder filler of 0.8 mm in particle diameter (KMP series product of Sin-etsu Kagaku Kogyo) was prepared by stirring and sprayed onto the core 2 which was then baked at 3000° C. for 30 minutes in a batch furnace to form a fluororesin layer 4 thereon.

By making use of the fluororesin layer mixed with the filler agent, improvement in such advantages may be obtained as affinity to anti-offset agent, in quality of image by virtue of a reduced surface hardness of the fixing roller.

Dispersion of the filler in the fluororesin 4 depends on the kind of additive (e.g., silicone oil and silicone powder), particle size, baking temperature, baking duration and other related conditions. It is desired to coat and bake the mixture on the core under such conditions that a major part of the filler particles are dispersed in the top surface of the fluororesin layer 4. The fluororesin layer 4 thus formed on the core can contain a large part of filler elements in the top surface. This makes it possible to save a total amount of filler added and minimize a decrease of mechanical strength of the fluororesin layer 4.

As an example, of silicone powder that is used as the filler agent, a fluororesin may come together near the outer surface (poor in filler) when baked at a high temperature higher than 3500° C., while silicone-rubber may excessibly exist in the surface when baked at a relatively low temperature lower than 3000° C. Accordingly, it is desired to bake the fluororesin layer with silicone powder filler at a temperature of lower than 3000° C. as described in the above-described example. The fluororesin layer 4 thus formed contains a plenty of filler elements in its outer surface and, at the same time, has a reduced filler content in total.

[Embodiment 3]

Figure 3:
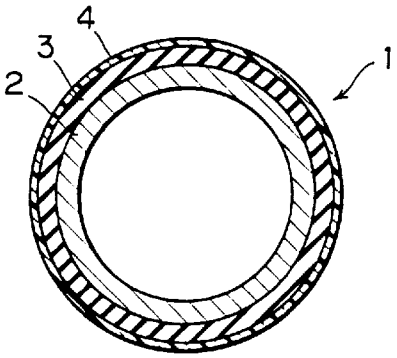
FIG. 3 is a schematic sectional view of a toner-image fixing roller which is the third embodiment of the present invention.

FIG. 3 shows a toner-image fixing roller which is a third embodiment of the present invention.

In FIG. 3, a fixing roller 1 is constructed of a core 2, an elastic layer 3 formed on a cylindrical surface of the core 2 and a fluororesin layer 4 covering the elastic layer 3. The core 2 and the elastic layer are the same as those of the first embodiment, so they will not be described further. The resin layer 4 will be described in detail below:

The resin layer 4 is made of a resin copolymer in which fluororesin monomer and silicone monomer having affinity to anti-offset agent are combined. The resin layer 4 may be formed on the elastic layer 3 by either of two methods: one method is to apply dispersion liquid of copolymerized resin to the elastic layer and then bake them together; and the other method is to previously form a tube of fluororesin and integrally form the tube with the elastic layer on the core or bond it onto the elastic layer 3 formed on the core.

In comparison with the embodiments 1 and 2 in which the resin layer of the fixing roller is made of fluororesin mixed with filler, this embodiment forms a resin layer of copolymerized resin, which offers the following advantageous features:

(1) Mechanical strength of resin layer is improved.

(2) The resin layer does not swell with silicone filler.

In short, the copolymerized resin layer has an excellent performance that can not be attained by a simple blended resin.

Silicone monomer and fluororesin monomer can be combined to form a copolymer by either of the well-known block copolymerizing method or graft copolymerizing method.

A practical example of forming the resin layer on the roller core is as follows:

A block copolymer of ABA triblock type polymers containing a hard segment A of PTFE and a soft segment B of polydimethylsiloxane together resin is formed into a 50 mm wall thick tube by extrusion. The tube is mounted and bonded onto the elastic layer 3 with one-liquid component silicone-rubber adhesive, thus forming the resin layer shown in FIG. 3.

It is also possible to use a graft copolymer, for example, in which a segment of PFA unit is chemically combined with an organopolysiloxane segment.

The block or graft copolymerizing method is thus used to obtain a copolymer from two kinds of monomers, which maintains natural properties of these two different monomers and possesses the above-mentioned improved performance that can not be obtained by a simply blended resin.

Figure 4:
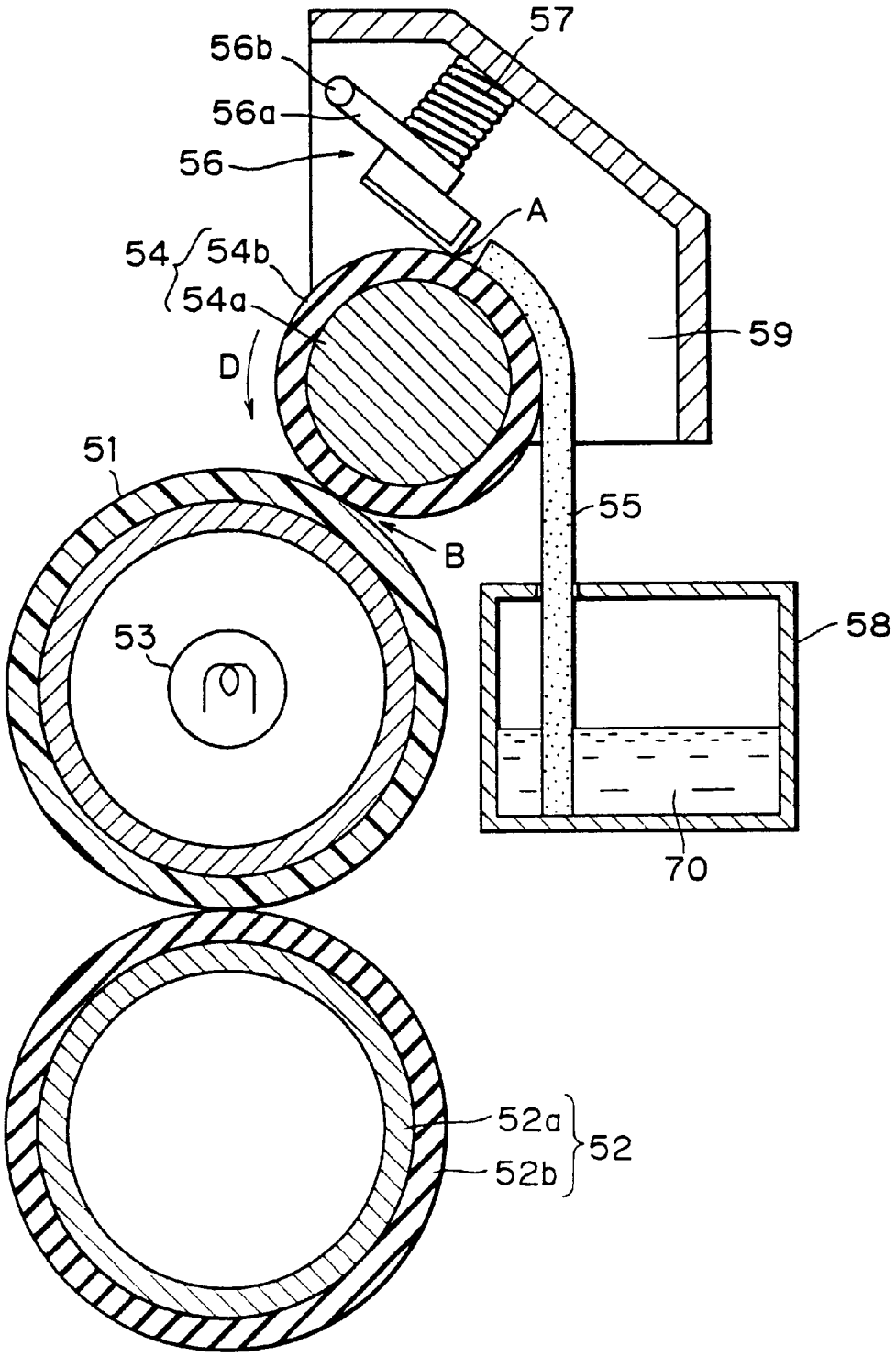
FIG. 4 is a schematic construction view of a toner-image fixing device embodying the present invention.
Figure 5:
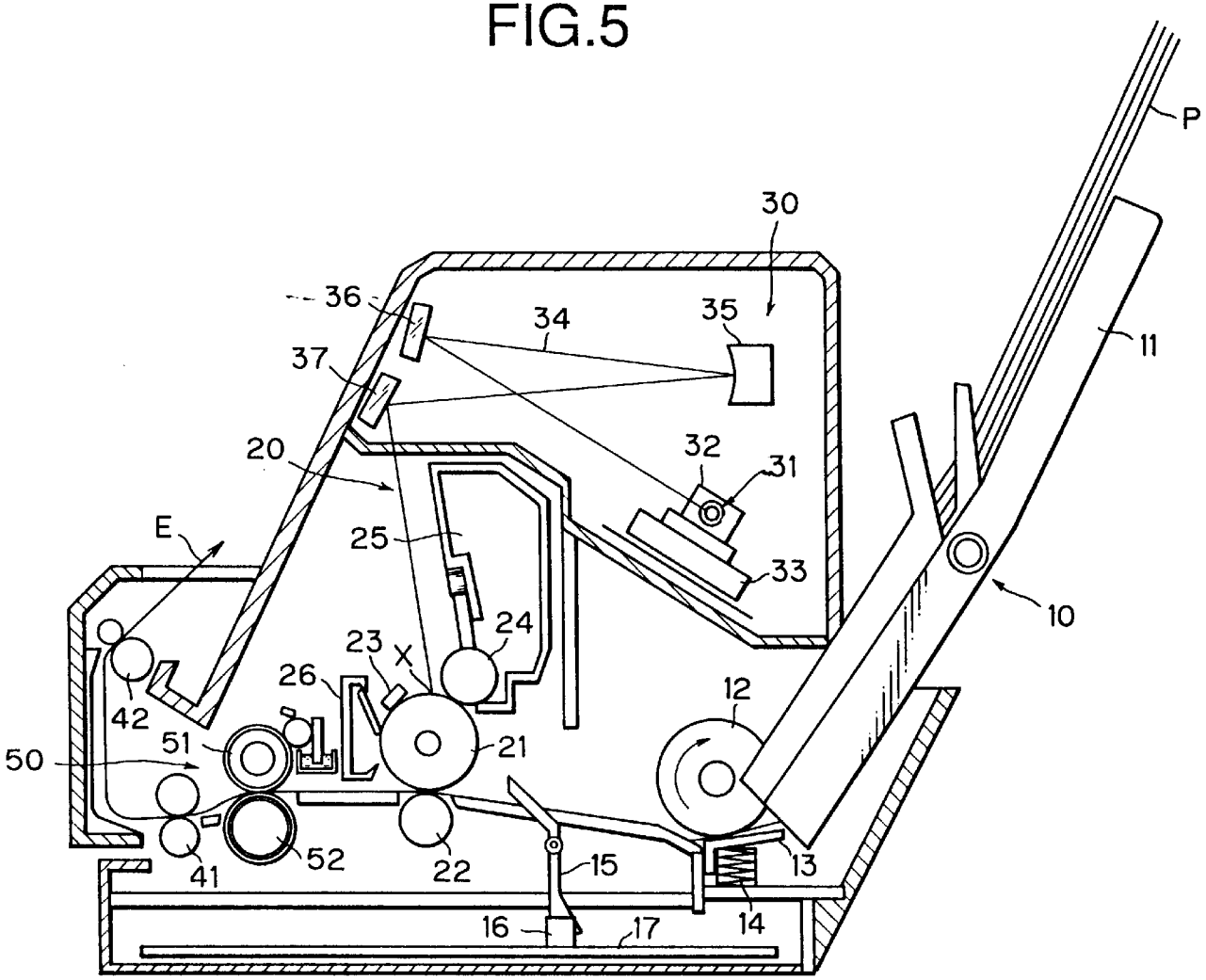
FIG. 5 is a schematic construction view of a laser printer which is provided with the toner-image fixing device shown in FIG. 4.

FIGS. 4 and 5 show a toner-image fixing device having a fixing roller according to the present invention, which is used in a laser printer being an electrophotographic apparatus.

As shown in FIG. 5, the laser printer provided with a fixing device of the present invention comprises a paper feeding section 10, an image forming section 20, a laser scanning section 30 and a toner-image fixing device 50.

The thus constructed laser printer transfers a recording paper sheet P from the paper feeding section 10 to the image forming section 20 where a toner image is formed by the action of laser beam 34 and is transferred to the recording paper sheet P. The paper sheet P carrying an unfixed toner image thereon is further transported to the toner-image fixing device 50 for fixing the toner image onto the sheet P by heat. The recording paper sheet P with the fixed toner image is transported by transporting rollers 41 and 42 disposed at the downstream side of the toner-image fixing device 50 and delivered out of the laser printer. Namely, the paper sheet P is transported along a path shown by an arrow E from a paper feeding tray 11 to the image forming section 20 and then the toner-image fixing device 50 wherefrom it is finally delivered out of the printer.

The paper feeding section 10 has a paper feeding tray 11, a paper feeding roller 12, a sheet separating friction board 13, a pressure spring 14, a paper detection actuator 15, a paper sensing element 16 and a control circuit 17.

Upon receipt of a "print" request command, the laser printer feeds one of paper sheets P piled on the paper feeding tray 11 into the printer body by means of the feeding roller 12, friction board 13 and the pressure spring 14. The paper sheet P kicks down the paper detection actuator 15 to cause the paper sensing element (optical sensor) 16 to produce an electric output signal <image printing start>. The control circuit 17 is turned ON by the action of the actuator and transmits an image signal to a laser light-emitting diode unit 31 of the laser scanning section 30 to selectively turn on the light-emitting diodes therein according to the image signal given from the control circuit 17.

The laser scanning section 30 is provided with a laser light-emitting diode unit 31, a scanning mirror 32, a scanning mirror driving motor 33 and reflecting mirrors 35, 36 and 37.

The scanning mirror 32 is driven by the scanning mirror driving motor 33 to rotate at a high constant speed. In FIG. 5, laser beam 34 scans vertically relative to the paper sheet P. The laser beam 34 emitted from the laser light emitting diode unit 31 is directed to the light-sensitive drum 21 to be described later through reflection mirrors 36, 35 and 37. At this time, the laser beam 34 is exposed selectively on the surface of the photosensitive drum 21 according to the <light on/off> information from the control circuit 17. The image forming section 20 is provided with a photosensitive drum 21, a toner-image transfer roller 22, a charging member 23, a developing roller 24, a developing unit 25 and a cleaning unit 26.

The charging member 23 previously charges the surface of the photosensitive drum 21. The electrically charged surface of the photosensitive drum 21 is selectively discharged by the action of the laser beam 43 to produce a latent image thereon. Toner for developing the latent image is stored in the developing unit 25. The toner is electrically charged by suitably stirring in the developing unit 25 and transferred from the developing roller 24 to the photosensitive drum 21 by the action of a developing bias voltage of the developing roller 24 and an electric field produced by the surface potential of the photosensitive drum 21. Thus, the latent image on the drum 21 is developed with toner.

The paper sheet P fed from the paper feeding section 10 enters into a path (nip) between the toner-image transfer roller 22 and the light-sensitive drum 21. The toner image on the light-sensitive drum 21 is transferred onto the paper sheet P by an electrically attracting force of an electric field produced by a toner transferring voltage applied to the transfer roller 22. Toner is transferred onto the paper and toner remaining on the drum 21 is removed by the cleaning unit 26.

The paper sheet P is then transported to the toner-image fixing device 50 whereby it is suitably heated and pressed by the fixing roller 51 constantly heated at 1700° C. and the pressure roller 52 respectively. The toner is fixed by fusing onto the paper sheet P.

The paper sheet with the fixed toner image is then delivered out of the printer by the transporting rollers 41 and 42.

Referring now to FIG. 4, a toner-image fixing device according to an aspect of the present invention is described in detail below.

A fixing roller 51 may be any one of the rollers described in the embodiments 1 to 3. A pressure roller 52 has a core 52*a* made of stainless steel with an elastic cover 52*b* made of silicone rubber. This pressure roller 52 is pressed at a predetermined force against the fixing roller 51 by using pressing means (not shown). The fixing roller 51 incorporates a heater-lamp 53 for heating the wall of the fixing roller at a predetermined temperature.

An oil applying device comprises an oil-applying roller 54, an oil applying felt 55, an oil feed limiting blade 56, a pressure spring 57, an oil tank 58 and a supporting frame 59. The oil tank 58 is filled with silicone oil 70 having a viscosity of 300 CS (Product KF-96 of Shin-etsu Kagaku Kogyo).

The oil applying roller 54 has a stainless steel core 54*a* covered with a silicone rubber layer 54*b* and is rotatably supported on the supporting frame 59. The oil applying roller 54 is pressed at a predetermined force against the fixing roller 51 by means of pressure means (not shown) and driven into rotation at the same peripheral speed as that of the fixing roller 51 by driving means (not shown). The oil applying felt 55 used is "Nomex" (product of Dupon Company) which is 550 g/m2 in weight and 2 mm in thickness. The felt 55 contacts at its top end with the oil applying roller 54 and is immersed into oil 70 in the oil tank 58 at its down end.

The oil feed limiting blade 56 is rotatably supported on a supporting point 56*b* of the supporting frame 59 and pressed against the oil applying roller 54 by a pressure spring 57 with a predetermined spring force on member 56*a*. In the oil applying device, oil 70 pumped up by capillary action of the oil applying felt from the oil tank 58 is supplied through the felt 55 onto the surface of the rotating oil-applying roller 54. The oil 70 on the oil-applying roller 54 rotating in the direction shown by an arrow D (FIG. 4) is adjusted at a predetermined even feed (height) by an edge portion A of the oil feed limiting blade 56 and transferred to the rotating fixing roller 51 through a contact portion B between the oil-applying roller 54 and the fixing roller 51.

Table 1 shows results of the experiments made on the toner-image fixing device 50 when assembled with respective fixing rollers 1 described as embodiments 1 to 3 of the present invention and, for the purpose of comparison, with a conventional fixing roller covered with a tubular layer of fluororesin not containing filler (silicone oil).

In every case, a contact angle of the fixing roller with silicone oil was measured and the uniformity of the silicone oil layer on the fixing roller was examined by an actual fixing action.

TABLE 1

| | Embodiment 1 | Embodiment 2 | Embodiment 3 | Conventional |
|---|---|---|---|---|
| Contact angle (0) with silicone oil | 18 | 12 | 0 | 40 |
| Evaluation of fixed toner-image quality by an actual fixing action. | 0 | 0 | 0 | X |

In Table 1, the image quality evaluation is indicated as follows: O (Good) is given to a printed image having no fixing defect due to nonuniformity of the silicone oil layer applied on the fixing roller and X (No good) is given to a printed image having any kind of defects such as uneven values of transmittance OHP, uneven values of gloss, toner offset and so on.

The experiment results show that the fixing rollers according to the present invention in comparison with the conventional fixing roller have a smaller contact angle with silicone oil, thus obtaining an improved wettability with respect to silicone oil. The results of quality evaluation of the toner images fixed on the respective test sheets by the respective fixing rollers of the present invention also show that the fixed images have no defect (uneven values of transmittance, uneven values of gloss and toner offset resulted from nonuniformity of a silicone oil layer), thus obtaining a satisfactory quality.

Table 2 shows results of experiments on the effect of the amount of added silicone oil filler in the fluororesin layer of the fixing rollers according to embodiments 1 and 2 of the present invention. Dimethylsilicone oil (KF-96 product of Shin-etsu Kagaku Kogyo) was used as the filler and the dependence of contact angle with silicone oil, fixed toner-image quality and life on the filler (silicone oil) content of the fluororesin layer of the fixing roller was examined.

TABLE 2

| | Silicone-oil content (%) | | | | |
|---|---|---|---|---|---|
| | 0.1 | 0.5 | 2 | 3 | 5 |
| Contact angle with silicone oil (0) | 35 | 25 | 18 | 16 | 15 |
| Evaluation of test printed image quality | X | 0 | 0 | 0 | 0 |
| Life (the number of prints) | 200 K | 180 K | 150 K | 120 K | 60 K |

In Table 2, the life is represented by the number of prints which were made for the aging test by an actual fixing action with no defect (ink offset and coiling of the paper around the surface of the fixing roller resulted from wearing and/or deterioration thereof) and satisfied the required quality.

As is apparent from the results, the silicone oil content of the fluororesin layer is desired to be more than 1% as to wettability with silicone oil and no more than 3% as to service life of the fixing roller. Similar test results were obtained for the fixing rollers having a fluororesin layer with silicone powder filler (KMP series filler of Shin-etsu Kagaku Kogyo). The silicone-powder content of the fluororesin layer is also desirable to be of 0.1 to 3%.

Table 3 shows the test results of the fixing rollers (embodiments 1 and 2) having a fluororesin layer with silicone powder filler as to the effect of powder size. KMP series silicone powder produced by Sin-etsu Kagaku Kogyo (silicone resin powder KMP series) is used as the filler and the dependence of service life of the fixing rollers on silicone powder size were examined.

TABLE 3

| | Silicone powder size (m) | | | | |
|---|---|---|---|---|---|
| | 0.8 | 2 | 7 | 13 | 20 |
| Life (the number of prints) | 200 K | 180 K | 160 K | 120 K | 60 K |

As is apparent from Table 3, durability of the fixing roller decreases as the silicone powder increases in size. The average particle diameter of the silicone powder is desirable to be smaller than 13 mm in view of the service life of the fixing roller.

Although in the above-described embodiments the nature of the present invention has been described as to be applied to the fixing rollers as fixing members, it goes without saying that it can also be applied to other fixing members (e.g., belt).

For example, the present invention can provide a fixing belt as one of the embodiments, which has a fluororesin surface layer containing filler having affinity to anti-offset agent. The fixing belt obtains an improved wettability with anti-offset agent, so its surface can be uniformly wetted with anti-offset liquid. Furthermore, the fixing belt has a reduced surface hardness, thus attaining an increased sharpness of edges of a toner-image fixed on a paper sheet. Filler may be silicone oil or silicone powder. The filler content of the fluororesin layer is also desired to be of 0.1 to 3.0%.

The silicone powder filler is desired to be smaller than 13 mm in average particle size.

The fixing belt may also have a fluororesin surface layer that contains a major part of filler elements in its outer surface and a small part in its inside and bottom. The fluororesin layer thus formed with a larger distribution of filler elements in its outer surface can attain an improved wettability with anti-offset liquid and an improved sharpness of edge portions of the fixed toner image at a minimum filler content of the fluororesin layer.

The toner-image fixing belt may have a surface layer made of a resin copolymer in which fluororesin monomer and silicone monomer having affinity to anti-offset liquid are combined.

In comparison with the fluororesin layer made of fluororesin mixed with filler, this resin layer made of a copolymer of two different resin monomers offers the following advantageous features:

(1) The resin layer itself has an improved mechanical strength.

(2) The resin layer does not swell with silicone filler.

In short, the copolymerized resin layer has an excellent performance that can not be attained by a simple blended resin.

Application of either one of the above-mentioned fixing belts together with means for applying anti-offset liquid thereto may create a toner-image fixing device which can obtain a fixed toner-image with no defect due to nonuniform application of anti-offset liquid and, furthermore, an improved sharpness of edge portions of the fixed image owing to a reduced surface hardness of the fixing belt.

As is apparent from the foregoing description, each of the toner-image fixing members according to the present invention has a surface layer made of fluororesin containing filler having affinity to anti-offset liquid. Accordingly, the surface of the fixing member can be uniformly wetted with anti-offset liquid owing to its improved wettability therewith. In addition, the fixing member can realize an improved sharpness of a toner image at edge portions owing to a reduced hardness of the working surface.

One aspect of the toner-image fixing roller of the present invention has a fluororesin surface layer containing filler affinity to anti-offset liquid. Accordingly, the surface of the fixing roller can be uniformly wetted with anti-offset liquid owing to its improved wettability therewith. Furthermore, the fixing roller can improve sharpness of a toner-image at edge portions owing to a reduced hardness of the working surface.

Silicone oil is used as a filler added to a fluororesin layer covering the toner-image fixing roller according to the present invention. This liquid filler can be easily added to and well dispersed in the fluororesin to be formed into a fluororesin layer of the fixing roller, which, therefore, has an excellent affinity to silicone oil to be used as an anti-offset liquid.

Silicone powder filler also can be used. In this case, the filler may adaptively reduce the surface hardness of the fluororesin layer to achieve an improved sharpness of edge portions of a toner-image fixed on a paper sheet.

The silicone oil or powder filler content of the fluororesin layer of the fixing roller according to the present invention is suitable to be of 0.1 to 3.0% in weight from the viewpoint of improving the wettability with anti-offset liquid and, at the same time, of assuring sufficient mechanical strength of the fluororesin layer.

The silicone powder filler is desired to have an average particle diameter of not larger than 13 mm. The use of sufficiently fine silicone powder in a relatively thick-formed fluororesin layer can minimize a possible decrease of the mechanical strength of the fluororesin layer.

Another aspect of the toner-image fixing roller of the present invention has a fluororesin layer that contains a major part of the filler elements in its outer surface and a small part in its middle and bottom. Such filler distribution makes the outer surface of the fluororesin layer have an improved wettability with anti-offset liquid at a minimum amount of filler added and, at the same time, have an ability of fixing a toner-image with an increased sharpness of its edge portions.

A further aspect of the toner-image fixing roller of the present invention has a surface layer made of a resin copolymer in which fluororesin monomer and silicone monomer having affinity to anti-offset agent are combined. In comparison with other aspects having the resin layer made of fluororesin mixed with filler, this toner fixing roller has a resin layer of copolymerized resin and offers the following advantageous features:

(1) The resin layer itself has an improved mechanical strength.

(2) The resin layer does not swell with silicone filler.

In short, the copolymerized resin layer has an excellent performance that can not be attained by a simple blended resin.

In the above-mentioned fixing roller, the copolymerized resin layer containing silicone monomer as its first monomer has an excellent affinity to silicone oil used as an anti-offset liquid, thus attaining further improved wettability with the anti-offset liquid.

In the toner-image fixing roller according to another aspect of the present invention, a fluororesin layer may be a tube made of fluororesin with filler, which is fitted on the fluororesin-covered fixing roller, or a layer of fluororesin with filler, which is directly applied and baked on a core of the fixing roller. The former two-layer construction of the fixing roller can minimize a decrease of mechanical strength of the surface layer of the fixing roller due to the filler added.

The toner-image fixing device according to the present invention is provided with a pair of fixing rollers being in rotatable contact with each other and anti-offset agent applying means for applying anti-offset agent to at least either one of the paired fixing rollers and is used for fixing an unfixed toner image by fusing onto a recording medium while the latter passing through a nipping portion of the paired fixing rollers, wherein at least either one of the paired fixing rollers is any one of the fixing rollers according to the present invention. This toner-image fixing device is capable of fixing a toner image on the recording medium by the fixing roller whose surface has a suitably reduced hardness and can be uniformly wetted with anti-offset liquid, thus obtaining a fixed toner image having a sharp edge portion and free from defects that may be caused if the roller is unevenly wetted with the anti-offset agent.

We claim:

1. A toner image fixing member for use with an anti-offset agent, said fixing member having a fluororesin surface layer containing a filler, wherein the filler comprises a material having an affinity to the anti-offset agent.

2. A toner image fixing roller for use with an anti-offset agent, said fixing roller having a fluororesin surface layer containing a filler, wherein the filler comprises a material having an affinity to the anti-offset agent.

3. A toner image fixing roller as defined in claim 2, wherein the filler is silicone powder.

4. A toner image fixing roller as defined in claim 3, wherein an average particle diameter of the silicone powder is not larger than 13 mm.

5. A toner image fixing roller as defined in any one of claims 2, 3 and 4, wherein the surface layer contains a large amount of the filler in its outer surface and a small amount in its inside.

6. A toner image fixing roller as defined in claim 2, wherein the fluororesin layer is formed as a fluororesin tube covering a cylindrical surface of the roller body.

7. A toner image fixing roller as defined in claim 2, wherein the fluororesin layer is formed by applying a fluororesin coat onto a core of the roller and baking it thereon.

8. A toner image fixing roller having a surface resin layer made of a resin copolymer composed of a first monomer having affinity to anti-offsetting agent and a second monomer comprising a fluororesin.

9. A toner image fixing roller as defined in claim 8, wherein the first monomer is a silicone monomer.

10. In a toner image fixing device having a pair of fixing rollers, both rollers being rotatable pressing against each other and anti-offset applying means for applying anti-offset agent to an external surface of at least one of said fixing rollers, fixing said unfixed toner image on the recording member by transporting said recording member carrying an unfixed toner image thereon between said pair of fixing rollers pressing against each other wherein at least one of the fixing rollers is a roller defined in any one of claims 2 and 9.

11. A toner image fixing roller having a fluororesin surface layer containing a silicone oil filler, wherein the filler has an affinity to anti-offset agent.

12. The toner image fixing roller of claim 11, wherein the surface layer contains from 0.1 to 3% silicone oil.

13. The toner image fixing roller of one of claims claim 11 or 12, wherein the surface layer contains a large amount of the filler in its outer surface and a small amount of filler in its inside.

14. A toner image fixing roller having a fluororesin surface layer containing a silicone powder filler, wherein the filler has an affinity to anti-offset agent and is present in the surface layer in an amount from 0.1 to 3% silicone oil.

15. The toner image fixing roller of claim 14, wherein the powder has an average particle diameter not larger than 13 mm.

16. The toner image fixing roller of one of claims claim 14 or 15, wherein the surface layer contains a large amount of the filler in its outer surface and a small amount of filler in its inside.

* * * * *